US008505835B2

(12) United States Patent
Scheffel

(10) Patent No.: US 8,505,835 B2
(45) Date of Patent: Aug. 13, 2013

(54) FUEL INJECTOR

(75) Inventor: Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 1713 days.

(21) Appl. No.: 11/592,882

(22) Filed: Nov. 2, 2006

(65) Prior Publication Data

US 2007/0114299 A1 May 24, 2007

(30) Foreign Application Priority Data

Nov. 2, 2005 (DE) ..... 10 2005 052 255

(51) Int. Cl.
*F02M 51/06* (2006.01)
*F02M 51/00* (2006.01)

(52) U.S. Cl.
USPC ..... 239/585.5; 239/585.1

(58) Field of Classification Search
USPC ..... 239/88, 533.2, 585.1–585.5; 251/129.15–129.21; 29/890.13
See application file for complete search history.

(56) References Cited

U.S. PATENT DOCUMENTS

| | | | | |
|---|---|---|---|---|
| 5,632,467 | A | 5/1997 | Just et al. | |
| 5,820,099 | A * | 10/1998 | Rahbar et al. | 251/129.15 |
| 6,000,628 | A | 12/1999 | Lorraine | |
| 6,302,371 | B1 * | 10/2001 | Reiter | 251/129.21 |
| 6,435,429 | B1 * | 8/2002 | Eichendorf et al. | 239/585.1 |
| 6,685,112 | B1 * | 2/2004 | Hornby et al. | 239/585.1 |
| 6,938,840 | B1 * | 9/2005 | Trutschel et al. | 239/533.12 |
| 7,093,585 | B2 * | 8/2006 | Bodenhausen et al. | 123/470 |
| 7,607,593 | B2 | 10/2009 | Akabane | |
| 7,637,443 | B2 * | 12/2009 | Scheffel et al. | 239/585.1 |
| 2003/0029930 | A1 * | 2/2003 | Ruehle et al. | 239/104 |
| 2006/0273274 | A1 | 12/2006 | Nagaoka | |

FOREIGN PATENT DOCUMENTS

| | | |
|---|---|---|
| DE | 40 03 227 | 1/1991 |
| DE | 195 03 821 | 8/1996 |
| EP | 068 56 43 | 12/1995 |
| EP | 155 08 04 | 7/2005 |
| WO | WO 99/51871 | 10/1999 |
| WO | WO 2004/088118 | 10/2004 |
| WO | WO 2005061150 A1 * | 7/2005 |
| WO | WO 2005/083261 | 9/2005 |

* cited by examiner

*Primary Examiner* — Darren W Gorman
(74) *Attorney, Agent, or Firm* — Kenyon & Kenyon LLP

(57) ABSTRACT

The fuel injector for fuel-injection systems of combustion engines has an excitable actuator for actuating a valve-closure member, which forms a sealing seat together with a valve-seat surface. At least one spray-discharge orifice is formed downstream from the valve-seat surface from which fuel is output in the direction of a combustion chamber. In addition, the fuel injector has a nozzle body, which surrounds the valve-seat surface or accommodates a valve-seat body having the valve-seat surface. The nozzle body is introduced into a downstream thin-walled extension of a connection piece, which also serves as an inner pole of a magnetic circuit, and is fixedly connected to this extension.

26 Claims, 1 Drawing Sheet

FUEL INJECTOR

BACKGROUND INFORMATION

In known fuel injectors operated as electromagnetically actuable valves, a valve tube forming the base element of the valve is made up of three individual components. A core and a valve-seat support are interconnected in a hydraulically sealing manner via a non-magnetic intermediate component, at least two joints and connection points being required (German Patent No. DE 40 03 227, for instance).

From German Patent Application No. DE 195 03 821, a fuel injector in which the number of components of the valve tube is reduced is already known, so that the number of joints and connection points is reduced as well. The entire valve tube is made of magnetically conductive or magnetizable material, so that no non-magnetic intermediate parts are required at all. In the region of the axial extension of a magnetic armature, the one- or two-part valve tube is provided with a thin-walled magnetic restriction, so that the magnetic lines of force in the magnetic circuit are routed in an effective manner.

SUMMARY OF THE INVENTION

The fuel injector according to the present invention has the advantage that it is able to be produced and adjusted in an especially simple and cost-effective manner. In addition, it is advantageous that the fuel injector has a particularly slim and space-saving design due to the measures according to the present invention. Since the nozzle body is introduced into a downstream extension of an elongated connection piece, which also serves as inner pole of a magnetic circuit and is fixedly connected to this extension, the valve tube extending across the entire length of the fuel injector is made up of only two components. Both components are able to be handled very easily. Compared to the axial lengths of nozzle body and connection piece, an overlap region of the two components has an only very short design. The lift of the valve needle is able to be adjusted at a shoulder of the nozzle body, close to the overlap region, in a very simple and cost-effective manner.

Since both components have thin walls in the overlap region of the extension of the connection piece and the nozzle body, the fixed connection is able to be achieved very easily.

It is advantageous to support the overlap region of connection piece and nozzle body on the outside with the aid of a support ring.

Using a magnetic cup, which is fixedly connected to the extension of the connection piece and mounted by pressing it on, in particular, the stability of the valve tube in the region of the extension of the connection piece is increased further.

DETAILED DESCRIPTION

Figure 1:
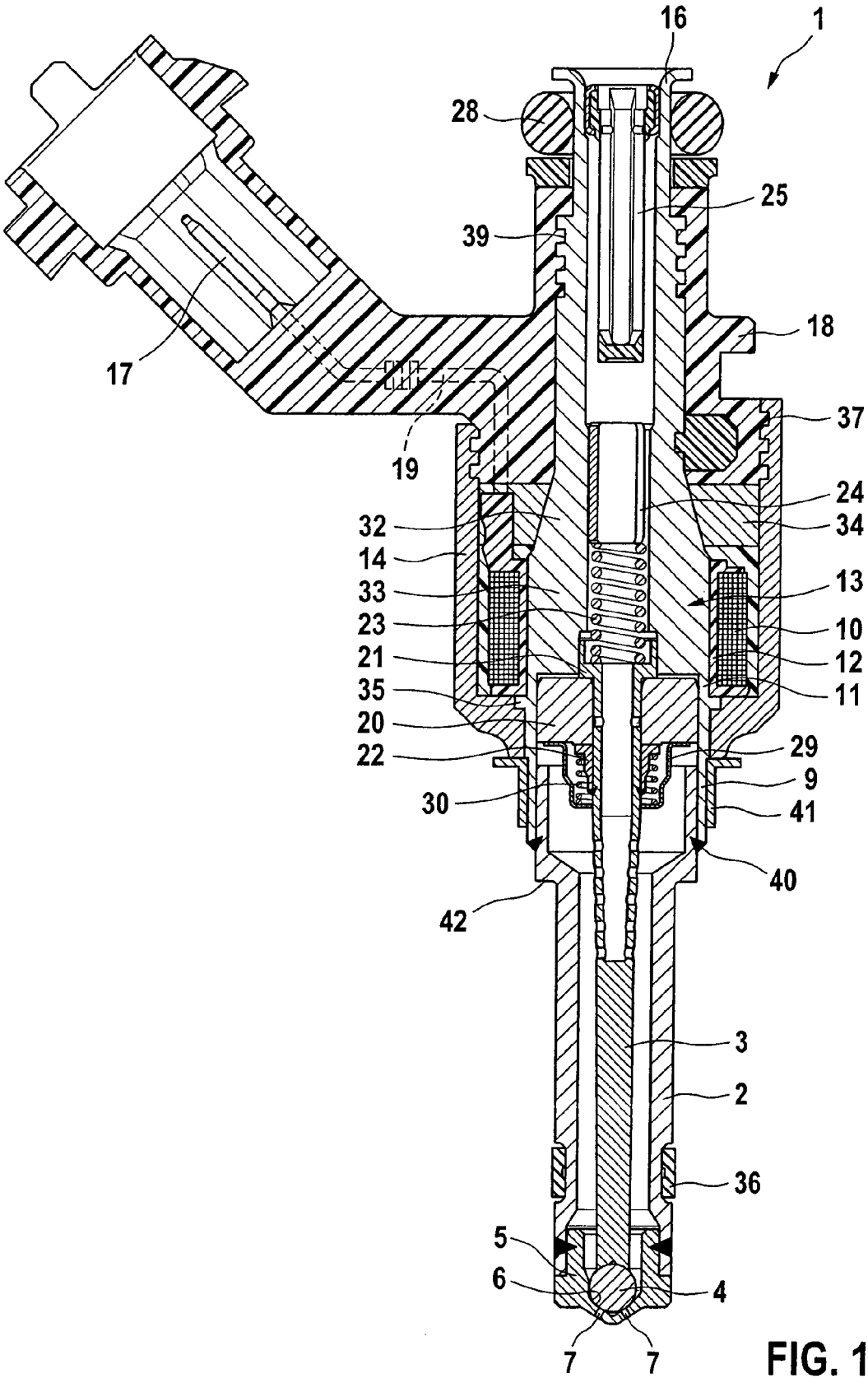
FIG. 1 shows a schematic section through an exemplary embodiment of a fuel injector configured according to the present invention.

An exemplary embodiment of a fuel injector 1 according to the present invention, shown in FIG. 1, is in the form of a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 which, as valve-seat support, is part of a valve housing and in which an axially displaceable valve needle 3 is situated. Valve needle 3 is mechanically linked to a valve-closure member 4, which cooperates with a valve-seat surface 6 formed on a valve-seat body 5 to form a sealing seat. With the aid of welding, for example, valve-seat body 5 is sealingly and fixedly secured to the downstream end of nozzle body 2. However, valve-seat surface 6 may also be formed directly on a base part of nozzle body 2. In the exemplary embodiment, fuel injector 1 is an inwardly opening fuel injector 1, which has at least one spray-discharge orifice 7 formed in valve-seat body 5. Nozzle body 2 is installed in a downstream extension 9 of an elongated connection piece 13, which forms part of the valve housing and is used as inner pole 33 of a magnetic circuit and is fixedly joined to this extension 9. The secure connection between connection piece 13 and nozzle body 2 is ensured with the aid of a welding seam 40, for example. In the overlap region of extension 9 of connection piece 13 and nozzle body 2, both components have relatively thin walls, the wall thicknesses in both components lying in the range of 0.5 mm to 0.9 mm, for instance. A support ring 41, which supports this overlap region on the outside and has an L-shaped cross section, has a wall thickness of approximately 0.3 mm, for example. The lift of valve needle 3 is able to be adjusted very easily and cost-effectively at a shoulder 42 of nozzle body 2, in the vicinity of the overlap region, by engagement of an adjusting tool (not shown). The thin-walled design of extension 9 and nozzle body 2 facilitates the pressing in of the components in and the adjustment of the lift.

An electromagnetic circuit, for instance, which includes a magnetic coil 10 wound onto a coil brace 12, which rests against connection piece 13 acting as inner pole 33, is used as drive. The region of inner pole 33 of connection piece 13 and extension 9 of connection piece 13 are largely separated from each other magnetically insofar as a thin-walled magnetic restriction 11 is provided between them in the region of the axial extension of a magnetic armature 20, the magnetic lines of force being routed around restriction 11. In the outward direction, the magnetic circuit is sealed by an outer magnetic component, which likewise forms the valve housing and in the present exemplary embodiment is designed in the form of a fully circumferential pot-shaped magnetic cup 14. Magnetic coil 10 is energized via a line 19 by an electric current that may be supplied via an electric plug contact 17. Plug contact 17 is enveloped by a plastic coat 18, which may be injection-molded onto connection piece 13 and extends up to the region between magnetic coil 10 and magnetic cup 14.

At its end facing fuel supply 16 of connection piece 13, magnetic cup 14 has a labyrinth seal 37 having a plurality of grooves. In this region of labyrinth seal 37, plastic coat 18 is injection-molded in a sealing manner.

Valve needle 3 penetrates magnetic armature 20 in an inner opening, magnetic armature 20 being disposed on valve needle 3 so as to be axially displaceable. The path of magnetic armature 20 is restricted by a first, upper flange 21, which is integrally formed with valve needle 3, and a second, lower flange 22, which is connected to valve needle 3, by force-locking and joined to valve needle 3 by a welding seam, for example. Braced on first flange 21 is a restoring spring 23, which in the present design of fuel injector 1 is prestressed by an adjustment sleeve 24.

The fuel is supplied via a central fuel supply 16 of connection piece 13 and filtered by a filter element 25 inserted therein. Fuel injector 1 is sealed from a fuel distributor line (not shown further) by a seal 28 and from a cylinder head (not shown further) by another seal 36.

In the quiescent state of fuel injector 1, restoring spring 23 acts upon first flange 21 of valve needle 3 counter to its lift direction, in such a way that valve-closure member 4 is retained in sealing contact against valve seat surface 6. Upon excitation of magnetic coil 10, it generates a magnetic field that moves magnetic armature 20 in the lift direction, counter to the spring force of restoring spring 23, the overall lift being defined by a working gap existing between connection piece 13 and magnetic armature 20 in the rest position. Magnetic armature 20 carries along first flange 21 in the lift direction as well. Valve-closure member 4, which is connected to valve needle 3, lifts off from valve seat surface 6, and the fuel is spray-discharged through spray-discharge orifices 7.

When the coil current is turned off, following sufficient decay of the magnetic field, magnetic armature 20 drops away from connection piece 13 due to the pressure of restoring spring 23, so that valve needle 3 moves counter to the lift direction. Valve closure member 4 sets down on valve seat surface 6, and fuel injector 1 is closed again. Bouncing of valve needle 3 during the closing operation is advantageously and effectively prevented in that magnetic armature is braked in its movement toward lower flange 22, counter to the lift direction, by the fluid cushion between magnetic armature 20 and flange 22, the fluid in this way being displaced radially toward the outside.

Disposed on the downstream side of magnetic armature 20 is a cup-shaped holding device 29 to accommodate an armature free path spring 30. On one side, armature free path spring 30 is braced on second, lower flange 22 and on the other side it is supported at the bottom of cup-shaped holding device 29, so that magnetic armature 20 is pulled in the direction of second flange 22 and magnetic armature 20 thus returns to its original position.

The components of the valve housing, in particular connection piece 13, magnetic cup 14 as well as nozzle body 2, are produced using MIM methods, for instance. In addition to such components of the valve housing of fuel injector 1, additional individual components may ideally be produced using MIM methods, for instance valve needle 3 having valve-closure member 4. The method, which is also known as metal injection molding (MIM), encompasses the production of molded parts made from a metal powder which includes an adhesive agent such as a plastic binding agent, which are mixed with each other and homogenized, using conventional plastic injection-molding machines, for instance, and the subsequent removal of the adhesive agent and sintering of the remaining metal powder framework. The composition of the metal power may be adapted to optimal magnetic and thermal properties in a simple manner.

However, it is also conceivable, for example, to produce nozzle body 2 as lathed component and magnetic cup 14 as extruded part. Given such a design of nozzle body 2 and magnetic cup 14, connection piece 13 is produced as lathed part as well, for instance. In addition to labyrinth seal 37, having a plurality of ribs, on magnetic cup 14, an additional labyrinth seal 39 also may be formed on the outer circumference of connection piece 13. Plastic coat 18 sealingly covers connection piece 13 in this region of labyrinth seal 39.

In the transition region of tubular fuel supply 16 to inner pole 33, connection piece 13 has a widening of the outer diameter, which extends conically, for instance. This conical section 32 of connection piece 13 is surrounded by a cover part 34, which overlaps coil brace 12 and is interrupted only in the region of line 19 for its feedthrough. Next to inner pole 33 is thin-walled magnetic restriction 11, which is followed by extension 9 further downstream. Extension 9 of connection piece 13 includes, for instance, a ring collar 35, which has a larger diameter and points radially toward the outside, and on which coil brace 12 having magnetic coil 10 is positioned. Magnetic cup 14 also extends below coil brace 12 and surrounds extension 9 of connection piece 13 to which it is fixedly connected. Magnetic cup 14 is mounted on connection piece 13 in such a way, for instance, that it is sealingly affixed by pressing and slipped up to the stop on ring collar 35. Extension 9 of connection piece 13 may be used to guide magnetic armature 20 and, furthermore, serves to accommodate nozzle body 2 to which connection piece 13 is likewise fixedly joined.

What is claimed is:

1. A fuel injector for a fuel-injection system of an internal combustion engine, comprising:

a valve-seat surface;

a valve-closure member for forming a sealing seat together with the valve-seat surface;

an excitable actuator for actuating the valve-closure member;

at least one spray-discharge orifice situated downstream from the valve-seat surface;

a one-piece connection element connecting to and extending from a fuel supply, the connection element being an inner pole of a magnetic circuit; and a nozzle body one of (a) including the valve-seat surface and (b) accommodating a valve-seat body having the valve-seat surface, the nozzle body being inserted into, and fixedly connected to, the connection element, wherein:

the nozzle body is held in the fixed connection to the connection element via a junction point at which the nozzle body and the connection element are directly joined;

the connection element includes a downstream extension that is delimited from a base section of the connection element by reduction of thickness of the extension relative to the base section, an enlarged cavity being formed by the reduction of the thickness; and the inner pole and the extension are magnetically separated from one another in that there is a thin-walled connection between them, which constitutes a magnetic restriction.

2. The fuel injector according to claim 1, wherein the fixed connection between the connection piece and the nozzle body is via a welding seam at the junction point.

3. The fuel injector according to claim 1, wherein the connection element houses a fuel filter element.

4. The fuel injector according to claim 1, further comprising:

a valve needle;

a restoring element upstream of the valve needle and biased for movement of the valve needle to a position in which the valve-closure member forms the sealing seat; and a prestressing element upstream of, and that prestresses, the restoring element;

wherein the restoring element, the prestressing element, and at least a portion of the valve needle are positioned within the connection element.

5. The fuel injector according to claim 1, wherein:

the one-piece connection element is shaped to include the base section serving as the inner pole of the magnetic circuit;

the downstream extension is of the same material as the base section and extends from an edge of the base section towards the valve-seat surface; and the nozzle body is inserted into the extension of the one-piece connection element.

6. The fuel injector according to claim 1, wherein the fixed connection between the connection piece and the nozzle body is via only a single welding seam at the junction point.

7. A fuel injector for a fuel-injection system of an internal combustion engine, comprising:

a valve-seat surface;

a valve-closure member for forming a sealing seat together with the valve-seat surface;

an excitable actuator for actuating the valve-closure member;

at least one spray-discharge orifice situated downstream from the valve-seat surface;

a connection piece; and a nozzle body one of (a) including the valve-seat surface and (b) accommodating a valve-seat body having the valve-seat surface, the nozzle body being inserted into a downstream extension of the connection piece, which is also used as an inner pole of a magnetic circuit, and being fixedly connected to the extension;

wherein the magnetic circuit is sealed by an outer magnetic component that is configured as a fully circumferential magnetic cup including side walls radially surrounding the excitable actuator and a bottom surface that extends underneath the excitable actuator.

8. The fuel injector according to claim 7, wherein the inner pole and the extension of the connection piece are magnetically separated from one another in that there is a thin-walled connection between them, which constitutes a magnetic restriction.

9. The fuel injector according to claim 7, further comprising a labyrinth seal having a plurality of grooves integrally molded on the magnetic cup, which seals the magnetic cup with respect to a plastic coat of the fuel injector.

10. The fuel injector according to claim 7, wherein the magnetic cup is fixedly connected to the extension of the connection piece, by pressing-on.

11. The fuel injector according to claim 7, wherein the fixed connection between the connection piece and the nozzle body is ensured with the aid of a welding seam.

12. The fuel injector according to claim 7, wherein the nozzle body and the connection piece have a thin-walled design in an overlap region of the extension of the connection piece and the nozzle body.

13. The fuel injector according to claim 12, wherein wall thicknesses in the overlap region of the connection piece and the nozzle body are each in the range of 0.5 mm to 0.9 mm.

14. The fuel injector according to claim 12, wherein the overlap region of the connection piece and the nozzle body is supported on the outside by a support ring.

15. The fuel injector according to claim 14, wherein the support ring has an L-shaped cross section.

16. The fuel injector according to claim 7, wherein the connection piece has an elongated design and also serves as a fuel supply of the fuel injector.

17. The fuel injector according to claim 16, wherein at least a portion of the valve-seat body is surrounded by at least a portion of the nozzle body.

18. The fuel injector according to claim 17, wherein the valve-seat surface is formed by at least a portion of a surface of the valve-seat body.

19. A fuel injector for a fuel-injection system of an internal combustion engine, comprising:

a valve-seat surface;

a valve-closure member for forming a sealing seat together with the valve-seat surface;

an excitable actuator for actuating the valve-closure member;

at least one spray-discharge orifice situated downstream from the valve-seat surface;

a connection piece; and a nozzle body one of (a) including the valve-seat surface and (b) accommodating a valve-seat body having the valve-seat surface, the nozzle body being inserted into, and fixedly connected to, a downstream extension of the connection piece, the connection piece being also used as an inner pole of a magnetic circuit;

wherein:

a portion the nozzle body and at least a portion of the extension of the connection piece overlap each other in an overlap region;

a portion of the nozzle is outside of the overlap region and does not overlap any portion of the connection piece;

a portion of the connection piece is outside the overlap region and does not overlap any portion of the nozzle body;

the portion of the nozzle body that is in the overlap region is more thin-walled than the portion of the nozzle body that is outside the overlap region;

the portion of the connection piece that is in the overlap region is more thin-walled than all of the portion of the computer piece that is outside the overlap region; and the inner pole and the extension are magnetically separated from one another in that there is a thin-walled connection between them, which constitutes a magnetic restriction.

20. The fuel injector according to claim 19, wherein the connection piece has an elongated design and also serves as a fuel supply of the fuel injector.

21. The fuel injector according to claim 19, wherein the fixed connection between the connection piece and the nozzle body is ensured with the aid of a welding seam.

22. The fuel injector according to claim 19, wherein wall thickness in the overlap region of the connection piece and the nozzle body are each in the range of 0.5 mm to 0.9 mm.

23. The fuel injector according to claim 19, wherein the overlap region of the connection piece and the nozzle body is supported by a support ring.

24. The fuel injector according to claim 23, wherein the support ring has an L-shaped cross section.

25. The fuel injector according to claim 19, wherein at least a portion of the valve-seat body is surrounded by at least a portion of the nozzle body.

26. The fuel injector according to claim 25, wherein the valve-seat surface is formed by at least a portion of a surface of the valve-seat body.

* * * * *